US005605204A

United States Patent [19]

Ausejo

[11] Patent Number: 5,605,204

[45] Date of Patent: Feb. 25, 1997

[54] MULTIDIRECTIONAL SCAFFOLDING

[75] Inventor: Felipe V. Ausejo, Oñate, Spain

[73] Assignee: Ulma, S. Coop. Ltda, Onate, Spain

[21] Appl. No.: 634,076

[22] Filed: Apr. 18, 1996

Related U.S. Application Data

[63] Continuation of Ser. No. 223,084, Apr. 4, 1994, abandoned.

[30] Foreign Application Priority Data

May 4, 1993 [ES] Spain ..... 9300941

[51] Int. Cl.[6] ..... E04G 7/00

[52] U.S. Cl. ..... 182/179; 403/49; 403/246

[58] Field of Search ..... 182/178, 179; 403/246, 49

[56] References Cited

U.S. PATENT DOCUMENTS

| | | | |
|---|---|---|---|
| 3,817,641 | 6/1974 | Steele | 182/179 X |
| 4,273,463 | 6/1981 | Dobersh | 403/246 |
| 4,867,274 | 9/1989 | Langer | 182/179 |
| 5,207,527 | 5/1993 | Duncan et al. | 403/246 |

FOREIGN PATENT DOCUMENTS

| | | | |
|---|---|---|---|
| 8903094 | 9/1989 | Spain . | |
| 1278243 | 6/1972 | United Kingdom | 403/49 |
| 2097507 | 11/1982 | United Kingdom | 182/179 |

*Primary Examiner*—Alvin C. Chin-Shue
*Attorney, Agent, or Firm*—Keck, Mahin & Cate

[57] ABSTRACT

Scaffolding includes standards to which ledger or tie tubes and diagonal braces are attached to form a removable three-dimensional truss. The ledger tubes and the braces are attached to the standards by fastening them at bores in discs fixed at regular intervals on the standards. The fastening is performed by hooks belonging in parts attached at the ends of the elements and is assisted by wedge keys.

2 Claims, 6 Drawing Sheets

MULTIDIRECTIONAL SCAFFOLDING

This is a continuation of Ser. No. 08/223,084, filed of Apr. 4, 1994, abandoned.

OBJECT OF THE INVENTION

The invention relates to a multidirectional scaffolding forming a truss made of standards to which ledger and tie tubes and diagonal braces are attached, to yield a three-dimensional metallic truss that is particular in that all its elements are removable and the attachments at the ends of both the ledger and the tie tubes and of the diagonal braces are fitted with fastening means.

BACKGROUND OF THE INVENTION

U.S. Pat. No. 8,903,094 of the same applicant claims a node for reticular structures, mainly designed to form scaffolding, based upon the use of upright standards or posts upon which ledger and tie tubes meet at various heights, together with stiffening braces laid obliquely or diagonally. Each upright standard in the truss or scaffolding obtained on the basis of the node claimed in such patent of invention, is fitted with a number of fixed rings in regular and suitable distribution, the rings being shaped as a diabolo, which defines a double annular pan facing opposite directions, suitable for receiving the clamping effect of the respective couplings provided to such end on the ledger and tie tubes, a part of the coupling being fixed and the other mobile in order for a wedge to be used for tightening during assembly.

Though the node having the aforesaid features fully effectively and pleasingly solved the problems inherent in conventional scaffolding, its drawback was that its cost was higher than what was desirable.

DESCRIPTION OF THE INVENTION

The scaffolding subject hereof, based upon a scaffolding comprising standards to which ledger and tie tubes and braces are joined to form a three-dimensional metallic truss, is particular in that the means of attachment of the ends of the ledger and tie tubes and indeed the braces use a simple catch comprising a sort of hook working with a wedge key, whereas the diabolo shaped rings referred to in the above paragraph are replaced by simple discs attached at regular intervals to the respective standards, which discs can indeed have a geometry other than a circle, although tending to have a round contour, being fitted with a number of bores that tend to be shaped as a trapezium, progressively narrowing towards the centre, being particular in that the bores are made in two different shapes, the bores or undercuts of a kind being staggered with those of the other kind in such a way that in some cases the bores or undercuts reach the very inner edge of the disc, closing, upon attachment, on the respective standard, whereas in the other case the bores or undercuts are at some distance from the centre, there being a phase difference between the same and indeed some amplitude insofar as length is concerned.

The hook referred to hereinabove will be housed in one of the bores, and held still by tightening with the appropriate wedge.

These fastening means provided at the ends of the ledger and tie tubes are attached to the latter by any conventional system, whereas the means provided at the diagonal braces require a bracket obliquely attached to the body making up the hook, which bracket is fitted with a bolt through which it is precisely linked to the end of the respective brace in order to allow the latter to be laid or mounted obliquely or diagonally to the bores or undercuts provided in the discs attached to the standards, for the discs are at all times horizontally arranged.

Clearly with such a simple and straightforward structure mounting and taking down will be very fast even in places that are difficult to reach.

Now the scaffolding structure will obviously, as usual, be supplemented with the appropriate planking defining passageways for the workmen to walk upon, whereas the standards shall be fitted at their bottom end with flat shoes having screw spindles making adjustment and levelling of the scaffolding as such easy.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figure 1:
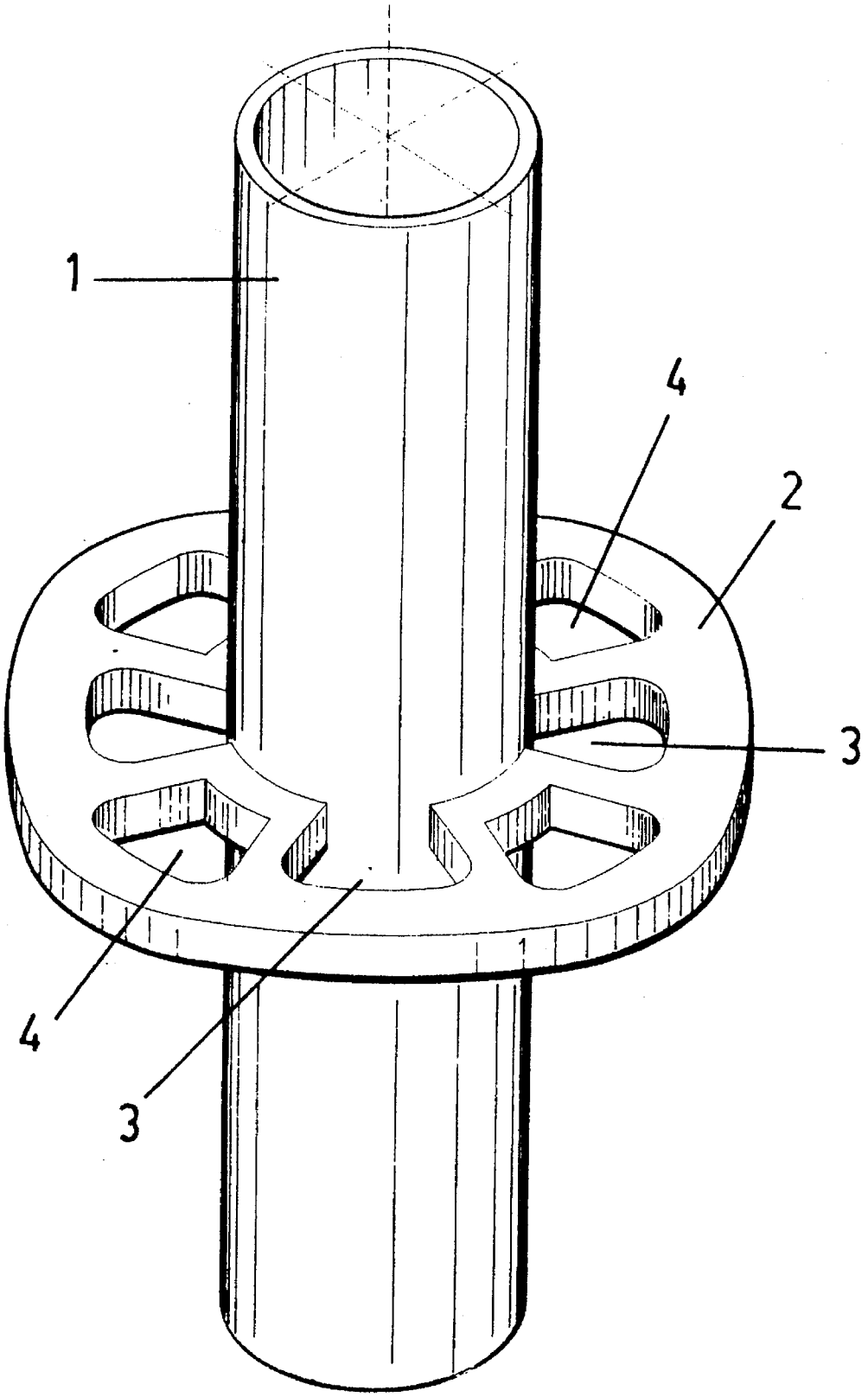
FIG. 1. Is a perspective overview of a portion of a standard having a ring provided with bores or undercuts, made in accordance with the object of the invention.
Figure 2:
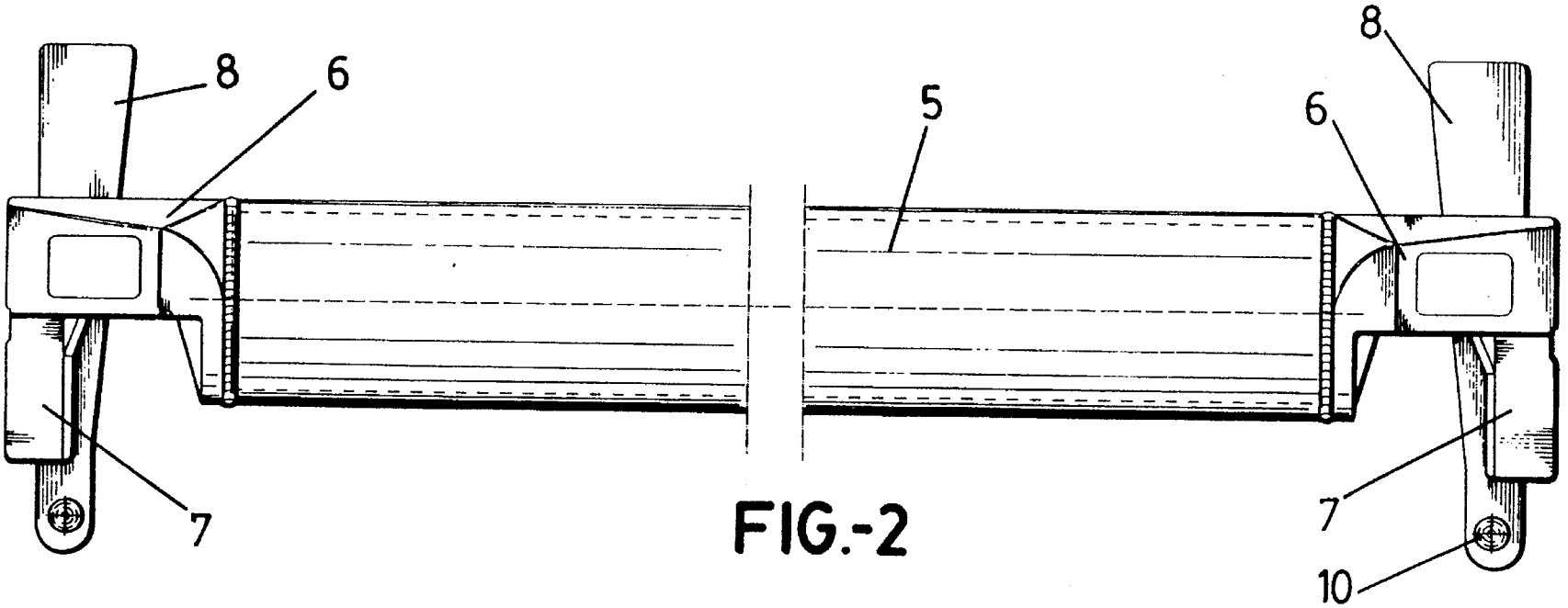
FIG. 2. Is a side elevation view of a ledger or tie tube with the respective end attachment elements, formed by a combination of the respective hook and wedge.
Figure 3:
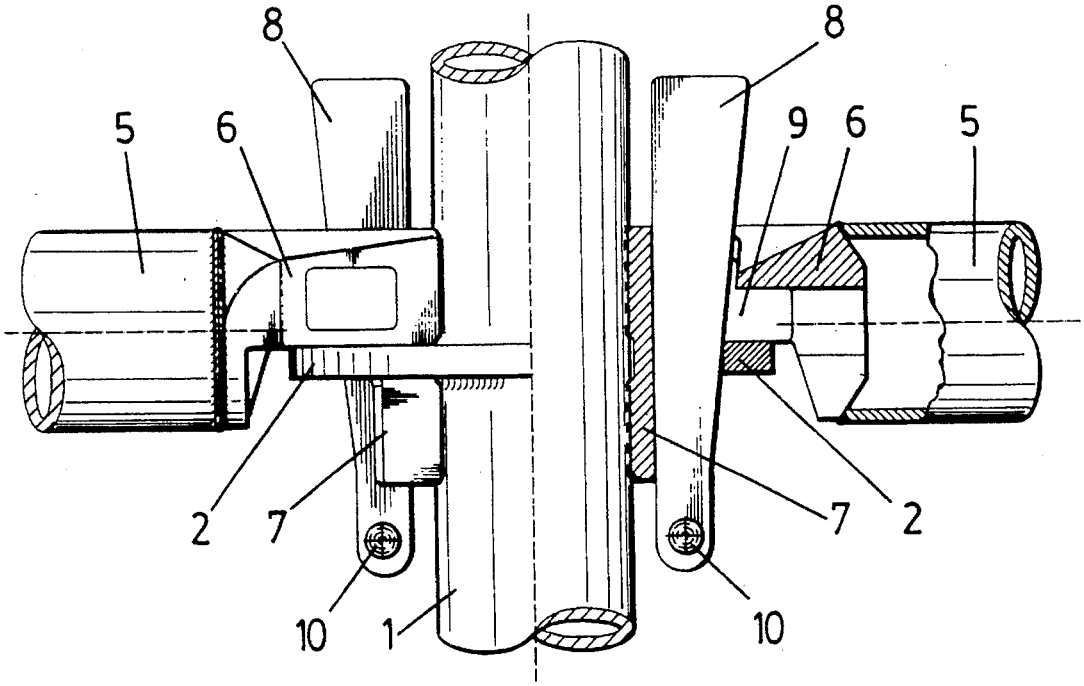
FIG. 3. Is a close view of two ledger or tie tubes fastened, to face one another, to the same ring on a standard, the fastening end of one of the ledger or tie tubes being driven and the other shown as a side elevation.
Figure 4:
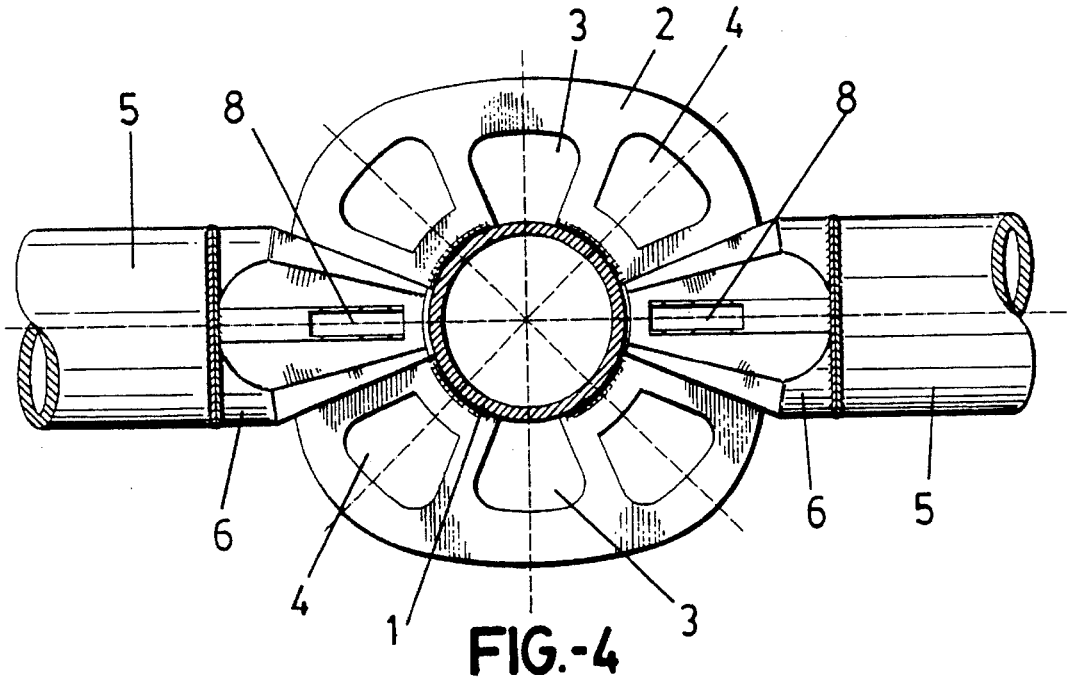
FIG. 4. Is a plan view of the attachment or joint shown in the previous figure.
Figure 5:
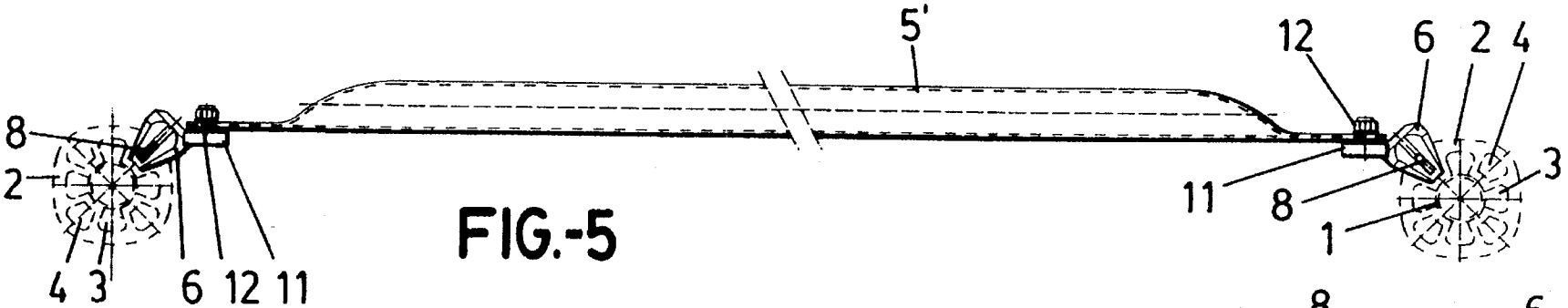
FIG. 5. Is a plan view of a brace attached at its ends to the respective discs provided on respective standards.
Figure 6:
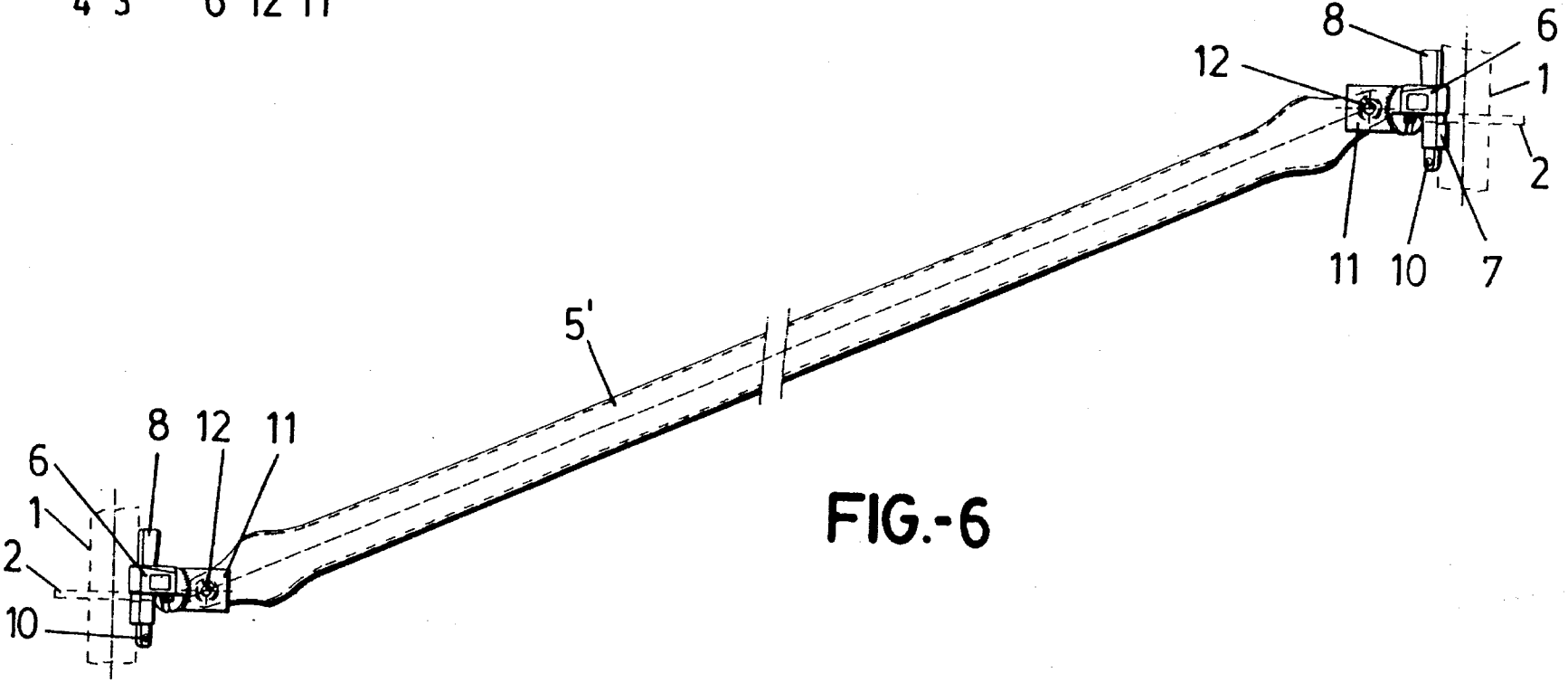
FIG. 6. Is a side elevation view of the brace shown in the previous figure at its joint to the respective discs belonging in the respective standards.
Figure 7:
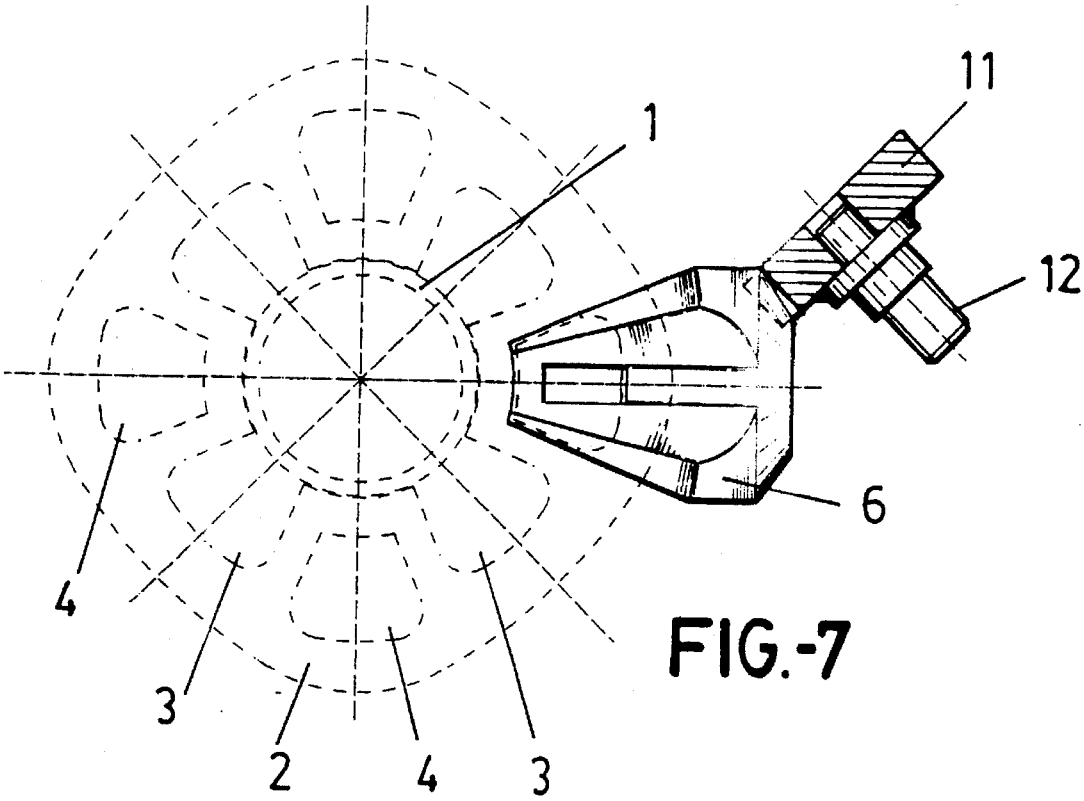
FIG. 7. Is a plan close view of the means of attachment of one of the ends of a diagonal brace.
Figure 8:
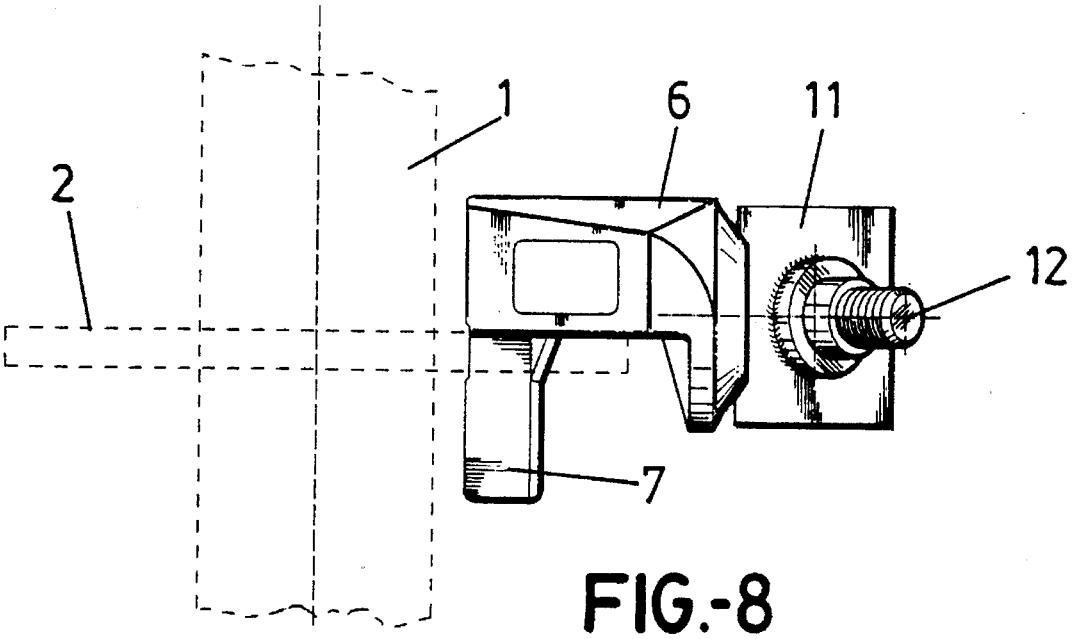
FIG. 8. Is a side elevation view of the actual attachment device shown in the previous figure, with the bracket attached to the fastening hook body, which bracket has a respective bolt to link the device to the end of the respective brace.
Figure 9:
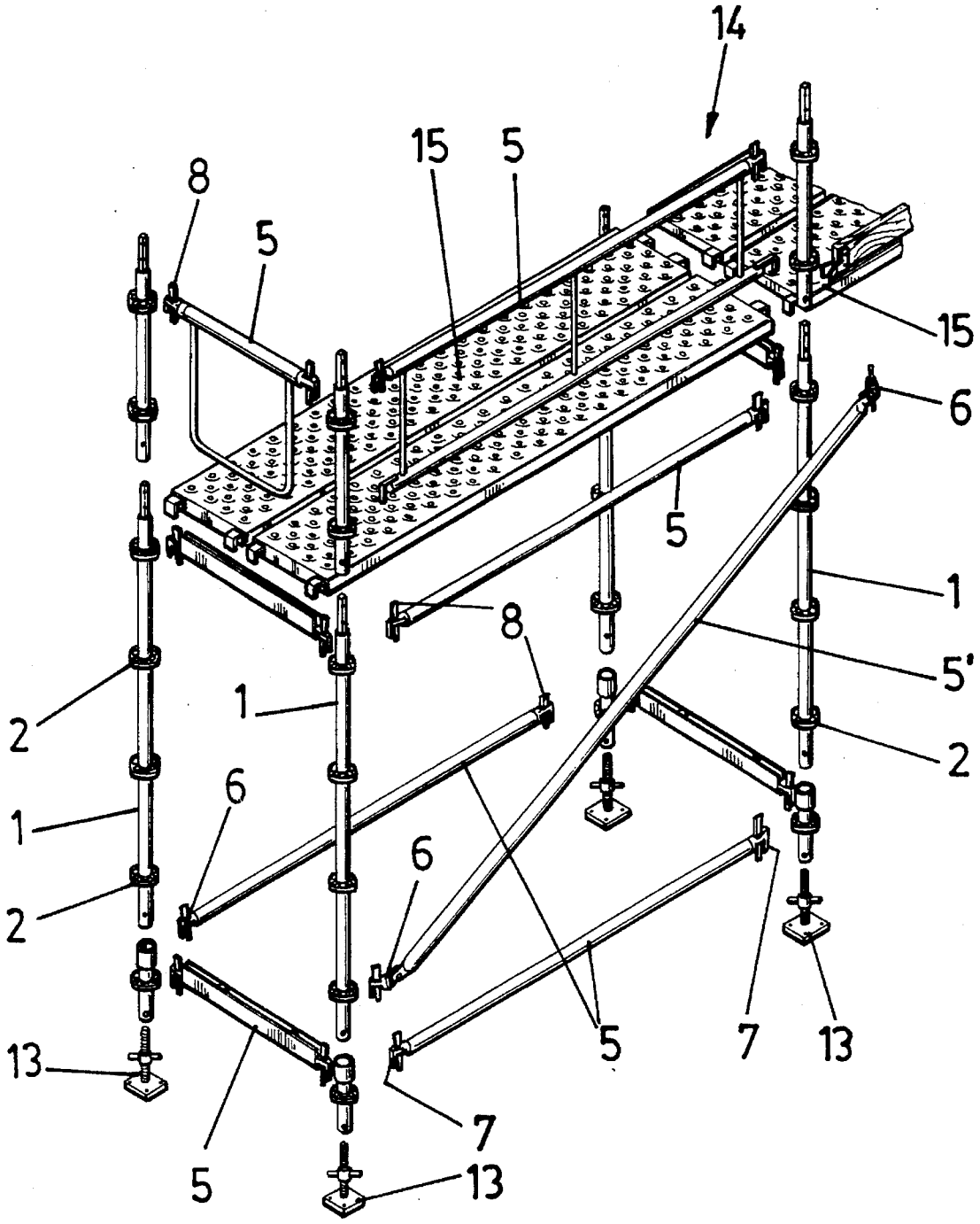
FIG. 9. Is finally an exploded overview of a scaffolding structure made in accordance with the invention.

In the light of the aforesaid figures, the multidirectional scaffolding subject hereof comprises attaching or linking a number of ledger and tie tubes and braces to standards (1) that are at regular and suitable intervals provided with a number of discs (2) having bores or cavities (3) and (4), the first of which make up undercuts on the inner disc (2) circumference and are closed by the side surface of the actual standard (1) upon and to which the disc (2) is respectively mounted and attached, whereas the bores (4) lie further away from the inner edge, which renders the same shorter, and located in staggered arrangement with the bores (3). In any event, both the bores or cavities (3) and the cavities (4) are generally shaped as a trapezium, the amplitude decreasing towards the centre. These bores or cavities (3) and (4) shall represent the fastening means for the ends of the respective ledger or tie tubes (5), or the actual braces (5') running diagonally or obliquely to stiffen the metallic scaffolding truss.

In the first case, viz. when dealing with ledger or tie tubes (5), their ends have extensions (6) ending in fastening hooks (7) that work with respective wedges (8) passing through slots (9) made to such end in the actual parts (6) that the said hooks (7) are a part of, the latter being secured by respective rivets (10) provided at the narrowest end of least amplitude.

The part (6) in which the hook (7) is conformed and to which a wedge key (8) is associated, when the braces (5') are to be attached, is supplemented with a bracket (11) that lies obliquely to the actual part (6), having a bolt (12) through which attachment to the end of the said brace (5') takes place, all in order that when the latter is mounted diagonally the hooks (7) can be housed upon the bores (3) and/or (4) of the discs (2) that are always mounted horizontally upon the standards (1).

The bores or cavities (3) are essentially provided for the hooks (7) of the fastening devices provided at the ends of the ledger or tie tubes (5) to be mounted, whereas the bores (4) are provided precisely for the hooks (7) being the fastening devices attached at the ends of the braces (5') to be mounted, though mounting can take place in either kind of said bores or holes (3) and (4) without distinction.

It finally remains to be said that the inclination of the brackets (11) fixed to the respective parts (6) for attachment to the ends of the braces (5') shall always be dependent upon the bearing that the latter are to have, that is to say depending upon whether they are mounted to be more or less oblique, so shall the inclination of the brackets (11) as such be, having bolts (12) for attachment of the braces (5) with respect to the fastening parts (6) to which they are attached.

The scaffolding is supplemented with the lower adjustable shoes (13) whereas its top can carry railings (14) also formed with ledger and tie tubes (5) attached to extensions of the standards (1), which railings shall protect the workmen walking on the planking (15).

I claim:

1. An improved scaffolding forming a removable three-dimensional truss comprising:

a plurality of standards;

a number of disc-shaped bodies integrally fitted to the standards and each having a first set of bores and a second set of bores defined therein, each bore of said first set of bores being an undercut extending radially outwardly from an inner circumference of one of said disc-shaped bodies and into the one of said disc-shaped bodies, each bore of said second set of bores being disposed between adjacent bores of said first set of bores and extending radially outwardly beyond said first set of bores from a location which is displaced away from said inner circumference and into the one of said disc-shaped bodies, wherein the bores of said first set of bores open towards a radial inside of the disc-shaped body and are closed by a side surface of the standard to which said disc-shaped body is attached;

a number of tie tubes removably attached to the standards, each of said tie tubes having opposite ends;

at least one stiffening brace obliquely and diagonally attached, at opposite ends, to at least two of said standards;

attachment parts at opposite ends of each of said tie tubes and at opposite ends of said at least one stiffening brace;

a fastening hook defined on each of the attachment parts, each fastening hook at ends of one of said tie tubes being insertable into one of the first set of bores for initial positioning and each fastening hook at ends of said at least one stiffening brace being insertable into one of the second set of bores for initial positioning; and wedge keys, each of which passes through one of said bores and a slot defined in each of the attachment parts to press and tighten each fastening hook for locking and attachment of each of the tie tubes and the at least one stiffening brace to the standards.

2. An improved scaffolding as defined in claim 1, wherein a pair of the attachment parts is integrally attached to the opposite ends of each of the tie tubes, and further comprising a bracket, integrally attached to each part of the pair of the attachment parts linked to the at least one stiffening brace through bolts forming a part of the bracket and arranged at an inclinatior relative to each part of the pair of the attachment parts.

* * * * *